United States Patent [19]

Gwynn

[11] 4,276,028

[45] Jun. 30, 1981

[54] GUNNERY TRAINING SYSTEM

[75] Inventor: Eric C. Gwynn, Hove, England

[73] Assignee: The Singer Company, Binghamton, N.Y.

[21] Appl. No.: 63,024

[22] Filed: Aug. 1, 1979

[30] Foreign Application Priority Data

Sep. 27, 1978 [UK] United Kingdom .... 38 378/78

[51] Int. Cl.[3] ..... F41G 3/26

[52] U.S. Cl. ..... 434/20

[58] Field of Search ..... 35/25

[56] References Cited

U.S. PATENT DOCUMENTS

| | | | |
|---|---|---|---|
| 2,662,305 | 12/1953 | Alric | 35/25 |
| 3,608,212 | 9/1971 | Lenneryd et al. | 35/25 |
| 3,965,582 | 6/1976 | Von Bennigsen | 35/25 |
| 3,996,674 | 12/1976 | Pardes et al. | 35/25 |
| 4,068,393 | 1/1978 | Tararine et al. | 35/25 |

*Primary Examiner*—William H. Grieb

*Attorney, Agent, or Firm*—Douglas M. Clarkson; Jeff Rothenberg

[57] ABSTRACT

A gunnery training simulator system is disclosed which includes a screen, a target projector for projecting onto the screen an image of a target, a spot projector for projecting onto the screen a spot of a predetermined radiation, the trace of which represents the path of a projectile being simulated, a television camera positioned to view the image and the spot trace, the camera being such that its line scan is in the vertical direction, and electronic means connected with the camera output for producing signal portions representative of the projectile trace and the target image and for producing an output signal when the projectile trace signal portion approaches to within a predetermined distance of the target image signal portion.

10 Claims, 4 Drawing Figures

GUNNERY TRAINING SYSTEM

BACKGROUND OF THE INVENTION

This invention relates to a gunnery training system of the type in which a target projector projects onto a screen an image of a target, and a spot projector projects onto the screen a spot which traces a path which represents the path of the projectile being simulated and which is dependent upon the sensed positions of various controls operated by the trainee.

The spot projector is mounted on servos, or contains servo-controlled mirrors, so that the tracer spot can be moved in accordance with the projectile trajectory. It is required to provide precise simulation of the possible projectile paths. It should be noted that the shot may pass to one side of the target, or if on the correct line may fall short of the target, be a direct hit, or overshoot. When the shot hits the ground or the target it must be extinguished.

If the round overshoots and falls behind the target, for realistic simulation the tracer spot should extinguish, or occult, as it falls behind the target. It would be possible to do this by sensing the instantaneous positions of the servos operating the two projectors and electronically calculating when the tracer spot falls on the area defined by the target. The resultant can then be used to switch off the spot projector.

We have found that the results obtained by this method are unreliable and unrealistic, at least when such occulting is required, due to the inherent tolerances and time lags of the projectors and their servos.

SUMMARY OF THE INVENTION

In accordance with this invention we provide a gunnery training system comprising a screen, a target projector for projecting onto the screen an image of a target, a spot projector for projecting onto the screen a spot the trace of which represents the path of a projectile being simulated, a television camera positioned to view the images and oriented such that its line scan is in the vertical direction, and electronic means connected to the camera output for producing signal portions representative of the projectile trace and of the target image, and for detecting on a line scan of the camera when the trace signal portion approaches to within a predetermined distance of the target signal portion and for providing a control output signal in response thereto.

Preferably the said predetermined distance is a function of the speed of vertical movement of the spot.

The control signal can thus be used to switch off the spot projector, preferably by closing a shutter mounted in its light path. The finite time taken for the shutter to close is compensated by the fact that the control signal is generated before actual coincidence of the trace and target.

BRIEF DESCRIPTION OF THE DRAWINGS

The invention will now be described in more detail, by way of example, with reference to the accompanying drawings, in which.

PRESENTLY PREFERRED EMBODIMENT

Figure 1:
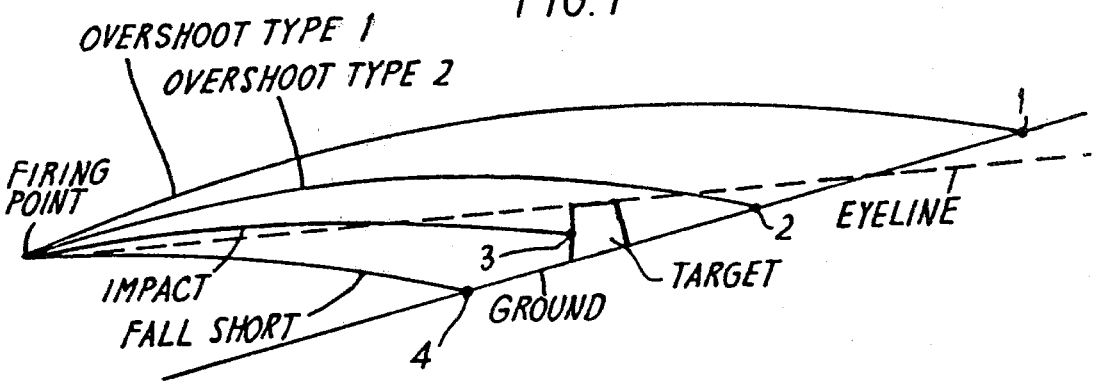
FIG. 1 is a diagram illustrating the possible fall of shot.

FIG. 1 shows the four basic different types of path which can be followed from a firing point by a projectile which is correctly aimed as to azimuth on a target. The four conditions are:

(a) The shot can fall short.

(b) The shot can impact with the target, i.e., be a hit.

(c) The shot can overshoot and land at a visible point well beyond the target, this being marked OVERSHOOT TYPE 1 on FIG. 1.

(d) The shot can overshoot and fall behind the target as seen from the firing point, this being marked OVERSHOOT TYPE 2 on FIG. 1.

The path followed depends for any given projectile on the weapon elevation.

In this last instance (d) the shot disappears behind the target and cannot be seen once it falls behind the eyeline. It is this situation which the invention is concerned to simulate.

Figure 2:
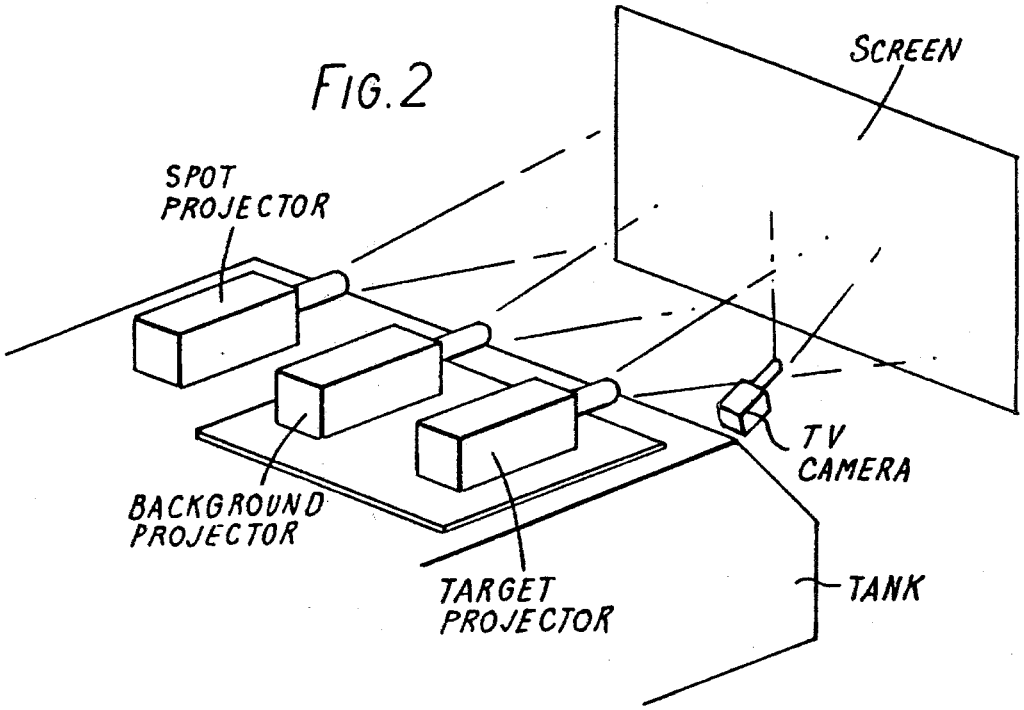
FIG. 2 shows the basic construction of the simulator.

FIG. 2 illustrates the basic physical components of a gunnery training simulator for simulating the weapon on a tank. On top of the simulated tank there are three projectors. A background projector projects a picture of a typical section of country onto a screen. A target projector projects a target, typically a moving target, onto the screen, and a spot projector projects onto the screen a spot which represents the trace of a projectile fired by the simulated weapon.

Target movement relative to the terrain is simulated by servos between the target projector and a platform on which the background projector is fixedly mounted. Tank movement relative to the terrain is simulated by moving the platform under servo control. Movement of the trace is simulated by rotating servo-controlled mirrors in the spot projector.

A television camera is positioned in front of the tank and views the composite scene projected on the screen. The TV camera provides an output which is processed, in accordance with this invention, to produce a signal when occulting is required.

Figure 3:
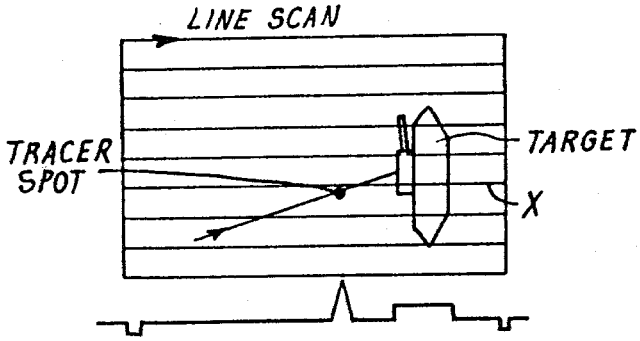
FIG. 3 illustrates the operation of the TV camera.

The scene viewed by the TV camera is schematically shown in FIG. 3. It will first be seen that the camera is rotated through 90 degrees from the conventional orientation so that the line scan is in the vertical direction from top to bottom of the screen. The tracer spot and the target stand out above the background scene.

FIG. 3 also shows the output waveform obtained on a particular line scan X. In this the tracer spot produces a high intensity peak, compared with the low intensity background, and the target produces a peak of intermediate intensity. The projector outputs are so arranged that the tracer, target and background sections of the camera output are of three mutually-distinguishable amplitudes.

The camera output is then processed as follows. The waveform is applied to two comparators, the first of which detects only the tracer pulse and provides a first pulse output signal in response thereto, and the second of which detects both tracer and target and provides a second output signal with two respective pulses. The first signal activates a timer circuit, conveniently comprising a monostable circuit and a bistable flip-flop circuit, such that the timer circuit will provide an output if the target pulse falls within a defined period after the tracer pulse.

Thus, as the tracer spot moves towards the target, an output will be generated as soon as the tracer and target approach to within a predetermined distance of one another, and this can be used to extinguish the tracer spot.

Figure 4:
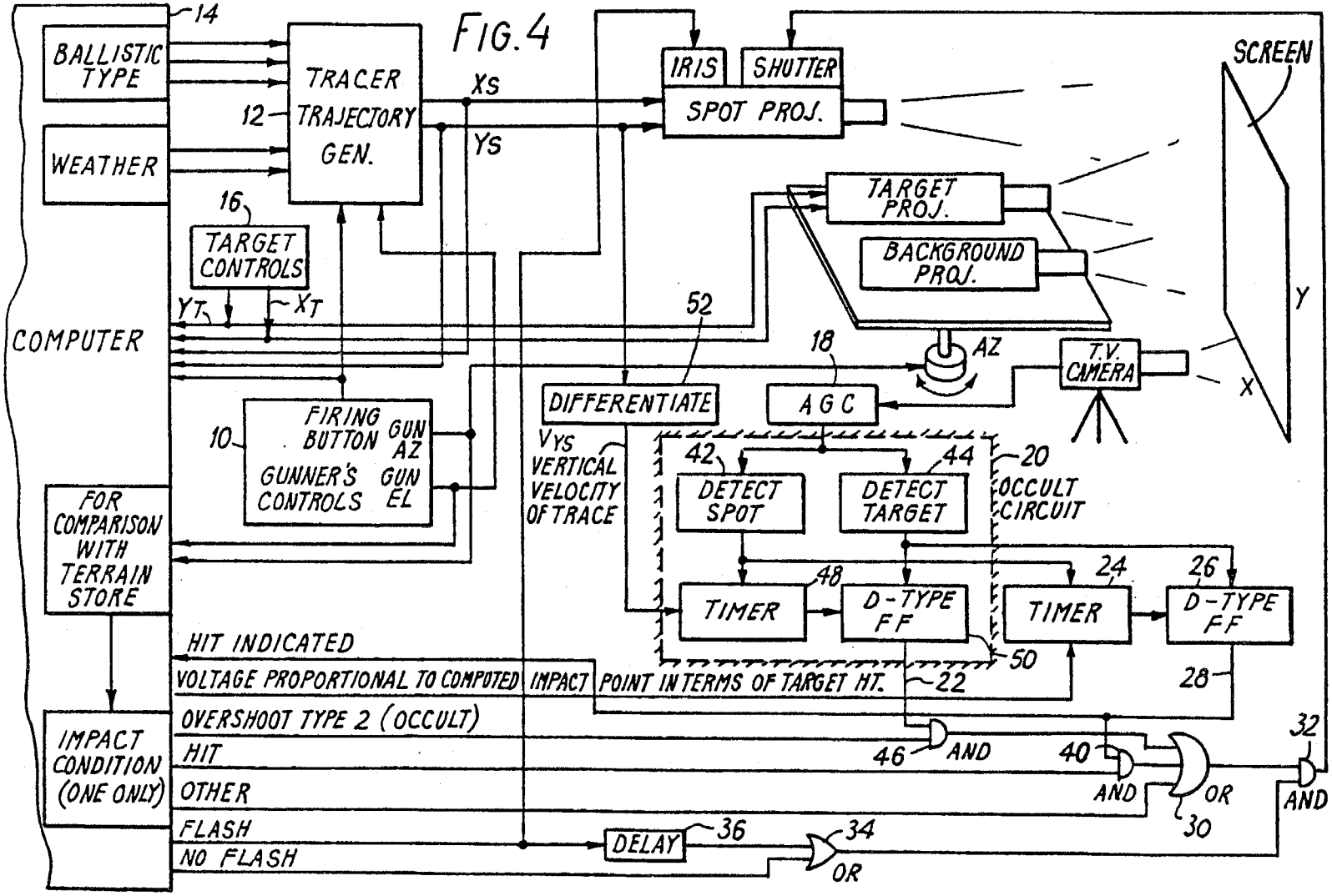
FIG. 4 is a block circuit diagram of the control circuitry for the spot projector.

Having described the principles of operation of one simulator embodying the invention, the control circuitry will now be described in more detail with reference to FIG. 4.

The simulator has controls 10 for the gunner which provide outputs representing the gun azimuth and elevation and also which provide an output when the firing button is pressed to initiate operation of the circuitry. When the firing button is pressed a tracer trajectory generator 12 is activated and, in dependence upon the gun elevation, and on the assumed weather conditions and projectile type stored in a computer 14, generates X and Y outputs Xs, Ys respectively for controlling the spot projector servos. The X, Y co-ordinates are related to the horizontal and vertical directions on the screen.

Target controls 16 are available to the umpire or controller and enable him to control the position of the target on the background. Corresponding signals $X_T$ and $Y_T$ are applied both to the target projector servos and to the computer.

The computer 14 also contains a terrain store which stores the assumed height of every XY point on the scene. Quite often this can be assumed to vary in a simply-expressed mathematical relation with Y. The terrain store also indicates whether the ground is hard or soft, i.e., whether the impact of the projectile would cause a flash or not. Also within the computer is an impact condition selector which determines whether the shot will produce (a) an overshoot requiring occulting or (b) a hit or (c) is of any other type, i.e., an overshoot not requiring occulting, or it falls short, or it is to one or other side of the target. One only of the three outputs of the impact condition selector is enabled on each shot. Subsidiary circuitry (not shown) detects whether a flash is required, either because a hit has occurred, or because the shot falls on hard ground such as rocks, but in either case only if the projectile is of appropriate type. Finally the computer provides an output voltage which allows for the fact that the target is of finite height and allows the spot to fall part-way down the target before registering a hit.

The TV camera output is applied through an AGC circuit 18 to an occulting circuit 20, the construction of which will be described below. The circuit 20 provides an output signal on a line 22 indicating the instant at which the spot projector shutter should be closed in the case of occulting. A timer 24 and bistable flip-flop circuit 26 co-operate to provide a signal on a line 28 indicating the instant at which the spot projector shutter should be closed in the case of a hit. This is applied to the computer for record purposes or to provide other (e.g. audible) simulation.

Thus when the firing button is pressed the computer compares the gun azimuth and elevation with the known target position and first determines whether the shot is going to be a hit, or an overshoot requiring occulting, or anything else. In the case of a hit or occulting the impact condition selector immediately enables the respective output. In any other situation, however, its "other" output is only enabled at the instant of impact as calculated by the computer.

Insofar as the computer implements known mathematical procedures to produce these outputs, further details are not believed necessary in this specification, as they will be appreciated by those familiar with the art.

For simplicity it will first be assumed that neither occulting nor impact is to take place. Thus the computer has only to compare the Xs and Ys coordinates with the terrain store to determine the instant at which the projectile will hit the ground. At that instant an output is applied to an OR gate 30. Also the computer determines from the terrain store whether a flash of light is to be produced on impact. If not an AND gate 32 is enabled via an OR gate 34 to allow the output of OR gate 30 to be passed to the shutter of the spot projector to close the shutter. If a flash is required, first a signal is applied to the iris in the spot projector to open the iris momentarily, and after a brief delay in a delay circuit 36 the AND gate 32 is again enabled via OR gate 34.

If either occulting or target impact is to occur, then the timing of the spot projector shutter closure is no longer obtained from the computer, but instead the TV camera is used to provide a more accurate indication of the required instant of shutter closure.

Assuming a direct hit is predicted by the computer, AND gate 40 will be enabled. Now, the occult circuit 20 contains a spot detector 42 which senses only the high peak of the camera output (see FIG. 3) corresponding to the tracer spot. A target detector 44 senses additionally the intermediate-amplitude pulse corresponding to the target. The spot detector 42 activates the timer 24 which receives from the computer the previously-mentioned signal dependent on target height and defines a "window" following the occurrence of the tracer pulse. The timer 24 enables the D-type flip-flop 26 during this window so that if a target pulse is detected during the window a signal is generated on line 28. This signal then enables the other input of AND gate 42, causing a signal to be applied to the OR gate 30. This closes the shutter of the spot projector, as described above.

The rate of scan of the TV camera is very fast compared with the rate of movement of the spot, so that effectively a hit signal will be generated as the target pulse reaches the end of the window defined by the timer 24.

Finally the operation of the system when occulting is to occur will be described. In this case an AND gate 46 is enabled by the computer. A timer 48 and a D-type flip-flop circuit 50 operate similarly to the timer 24 and flip-flop circuit 26, so that a pulse will appear on line 22 from the circuit 50 when the target and tracer spot approach each other to within a predetermined vertical distance. It is arranged that this distance is dependent upon the vertical velocity of the spot, which is conveniently obtained by differentiating the signal Ys in a differentiator 52. The greater the vertical velocity, the greater the said distance, so that the time between generation of the signal and the moment when the spot is in line with the top of the target is substantially constant. This time is, of course, approximately the time taken for the spot projector shutter to close.

In this way reliable indications can be given of both a hit and an occulting situation, and the spot will be extinguished at the correct moment.

It is also possible to provide an indication to the instructor of the accuracy of aim by displaying a measure of the miss distance, for example in terms of degrees of horizontal and vertical. The point at which the tracer passes through the target plane is assessable, and the amount by which the target distance and tracer distance differ is capable of evaluation since the television field of view is known. Such additional display is especially valuable in the case of an occulted overshoot.

While the presently preferred embodiment of the invention has been described, it should be obvious to one skilled in the art that various changes and modifications may be made without departing from the invention. It is intended, however, that all such changes and modifications are within the true spirit and scope of the invention, as defined by the claims appended hereto.

What is claimed is:

1. A gunnery training simulator system wherein a spot of a predetermined radiation is adapted to trace a path of a projectile being simulated on a screen onto which the image of a target is projected, comprising:

a screen, a target projector for projecting onto the screen an image of a target, a spot projector for projecting onto the screen a spot of a predetermined radiation the trace of which represents the path of a projectile being simulated, camera means positioned to view the target image and the spot of radiation, and electronic means connected to the output of the camera means for producing signal portions representative of the projectile trace and of the target image and for producing an output signal when the projectile trace signal portion approaches to within a predetermined distance of the target image signal portion.

2. A gunnery training simulator system as set forth in claim 1 wherein said predetermined distance of the target image signal portion is a function of the speed of vertical movement of the spot.

3. A gunnery training simulator system as set forth in claim 1 wherein the control signal is connected to switch off the spot projector after a preselected interval of time.

4. A gunnery training simulator system as set forth in claim 3 wherein said control signal is connected to close a shutter mounted in the spot path of said radiation.

5. A gunnery training simulator system as set forth in claim 4 wherein the preselected interval of time taken for the shutter to close is compensated by the control signal being generated before actual coincidence of the trace and the target.

6. A gunnery training simulator system as set forth in claim 1 including a third projector for projecting an image of a scene onto the screen to provide a predetermined background for said target and for said simulated projectile path.

7. A gunnery training simulator system as set forth in claim 1 wherein said camera means is a television camera adapted so that its line scan is in a vertical direction.

8. A gunnery training simulator system as set forth in claim 6 wherein the output signal from said electronic means includes three mutually distinguishable amplitudes for said tracer, said target and said background signal portions.

9. A gunnery training simulator system as set forth in claim 7 wherein the rate of scan of said television camera is substantially faster than the rate of movement of said spot.

10. A gunnery training simulator system as set forth in claim 1 including timer circuit means activated by a spot detector circuit means in response to a signal peak of the output of said camera means corresponding to said projectile trace signal portion in order to activate a timer circuit for defining a "window", so that said spot detector is switched off by a target pulse detected during such "window".

* * * * *